US008390402B2

(12) United States Patent
Kunes

(10) Patent No.: US 8,390,402 B2
(45) Date of Patent: Mar. 5, 2013

(54) WAVEGUIDE COMPRISED OF VARIOUS FLEXIBLE INNER DIELECTRIC REGIONS

(75) Inventor: Mark Anthony Kunes, Hitchin (GB)

(73) Assignee: Astrium Limited, Hertfordshire (GB)

( * ) Notice: Subject to any disclaimer, the term of this patent is extended or adjusted under 35 U.S.C. 154(b) by 263 days.

(21) Appl. No.: 12/761,860

(22) Filed: Apr. 16, 2010

(65) Prior Publication Data

US 2011/0215887 A1 Sep. 8, 2011

(30) Foreign Application Priority Data

Mar. 3, 2010 (EP) ..... 10275025

(51) Int. Cl.
*H01P 3/14* (2006.01)

(52) U.S. Cl. ..... 333/241; 333/242

(58) Field of Classification Search ..... 333/239, 333/241, 242, 248, 157; 343/776
See application file for complete search history.

(56) References Cited

U.S. PATENT DOCUMENTS

| | | | | |
|---|---|---|---|---|
| 3,066,269 | A | 11/1962 | Barlow | |
| 3,275,955 | A * | 9/1966 | Prache | 333/242 |
| 3,275,956 | A * | 9/1966 | Prache | 333/242 |
| 3,845,426 | A | 10/1974 | Barlow | |
| 4,216,449 | A | 8/1980 | Käch | |
| 4,785,268 | A * | 11/1988 | Walter et al. | 333/157 |
| 4,786,913 | A * | 11/1988 | Barendregt et al. | 343/765 |
| 4,800,350 | A * | 1/1989 | Bridges et al. | 333/239 |
| 5,528,208 | A | 6/1996 | Kobayashi | |
| 2002/0101308 | A1 * | 8/2002 | Okamura et al. | 333/239 |
| 2005/0082004 | A1 | 4/2005 | Kasai | |

FOREIGN PATENT DOCUMENTS

FR 2 380 647 9/1978

OTHER PUBLICATIONS

European Search Report dated Jul. 5, 2010, issued in the corresponding European Application No. 10276026.4-1248.

* cited by examiner

*Primary Examiner* — Benny Lee
(74) *Attorney, Agent, or Firm* — Buchanan Ingersoll & Rooney PC

(57) ABSTRACT

A waveguide is provided that includes an elongate dielectric inner region, and an electrically conducting outer region spaced apart from the dielectric inner region. The dielectric inner region may be arranged to be flexible, and in some examples may be formed from powdered dielectric contained in a polymer tube or matrix, or in other examples may be formed from a plurality of segments. In some examples of the waveguide, each segment may be formed to have lenticular end faces, and may be formed from sintered $BaTi_4O_9$.

18 Claims, 7 Drawing Sheets

WAVEGUIDE COMPRISED OF VARIOUS FLEXIBLE INNER DIELECTRIC REGIONS

FIELD

The present invention relates to a waveguide. More particularly, the present invention relates to a waveguide having an elongate dielectric inner region, and an electrically conducting outer region spaced apart from the dielectric inner region.

BACKGROUND

Waveguides are commonly used in a wide range of applications, for guiding a wave along a desired path. For example, in a communications satellite, it may be necessary to pass a received microwave signal through a number of components (e.g. amplifiers, filters, multiplexers) before retransmitting the processed signal. In this case, an electromagnetic waveguide may be used to carry the signal from one component to the next.

FIGS. 1*a* and 1*b* illustrate a conventional rectangular waveguide 100 for guiding an electromagnetic wave. The waveguide 100 comprises a length of hollow metal pipe 101 with end flanges 102, 103 for attaching the waveguide 100 to the appropriate input/output ports. An electromagnetic wave propagates from one end of the waveguide 100 to the other by total internal reflection off the walls of the waveguide pipe 101. However, energy loss occurs due to current flowing in the walls of the waveguide pipe (the 'skin effect'), with typical losses being 0.13 dB/m in the Ku band and 0.37 dB/m in the Ka band. When long waveguide runs are used, the resulting losses can be as high as 50%. These losses can be reduced to a certain extent by increasing the cross-sectional dimensions of the waveguide. However, this significantly increases the overall weight of the waveguide, and so is not a viable option for applications where weight must be minimized, for example in satellites and other space-based applications.

The waveguide 100 of FIG. 1*a* is a straight waveguide, for use in situations when the input/output ports to be connected are in line with one another. When this is not the case, more complex waveguide sections must be custom-formed, since the waveguide pipe 101 is rigid and cannot be bent. Examples of such complex sections are shown in FIG. 1*b*, which illustrates a waveguide tee 110, a twisted waveguide 120, and a curved waveguide 130. Such sections are time-consuming and expensive to fabricate, since they must be custom made to fit the dimensions of each individual apparatus.

As an alternative, a flexible waveguide has been developed which has thin (~0.1 mm) corrugated walls, allowing the pipe to be bent and twisted. However, this type of waveguide suffers from even higher losses than regular waveguide, with typical losses being 0.8 dB/m in the Ku band and 2 dB/m in the Ka band.

SUMMARY

The present invention aims to address the drawbacks inherent in known arrangements.

According to the present invention, there is provided a waveguide comprising an elongate dielectric inner region, and an electrically conducting outer region spaced apart from the dielectric inner region.

The dielectric inner region may be arranged to be flexible.

The dielectric inner region may comprise either powdered dielectric contained within a flexible tube, or a flexible composite of dielectric particles in a polymer matrix.

The dielectric inner region may comprise a plurality of segments.

Each one of the plurality of segments may be formed to have lenticular end faces.

Each one of the plurality of segments may be formed to be substantially circular in a cross-section perpendicular to a long axis of the waveguide.

Each one of the plurality of segments may be formed from a sintered ceramic material.

The plurality of segments may be contained within a flexible polymer tube.

Each one of the plurality of segments may be formed to have a central through hole, and the waveguide may further comprise a thread running through the central hole of each segment.

The dielectric inner region may comprise barium tetratitanate $BaTi_4O_9$.

The waveguide may further comprise separating means for maintaining a separation between the inner region and outer region, the separating means comprising an electrical insulator.

The separating means may comprise foam arranged to surround the dielectric inner region, or a plurality of rigid annular discs, said discs being disposed at intervals along the length of the dielectric inner region, or a plurality of rigid radial arms attached to a flexible strip, said strip being wound around the dielectric inner region in a helical manner, or a plurality of spacers, each comprising a plurality of rigid radial arms attached to a central collar, said spacers being disposed at intervals along the length of the dielectric inner region.

The outer region may comprise a thin-walled metal tube or a braided metal wire tube.

In a cross-section perpendicular to a long axis of the waveguide, the outer region may be formed to have a substantially similar shape to the dielectric inner region, or may be formed to have a different shape to the dielectric inner region.

The waveguide may be arranged to guide electromagnetic radiation having a microwave wavelength.

DESCRIPTION OF THE DRAWINGS

Embodiments of the present invention will now be described, by way of example, with reference to the accompanying drawings, in which.

DETAILED DESCRIPTION

Figure 1A:
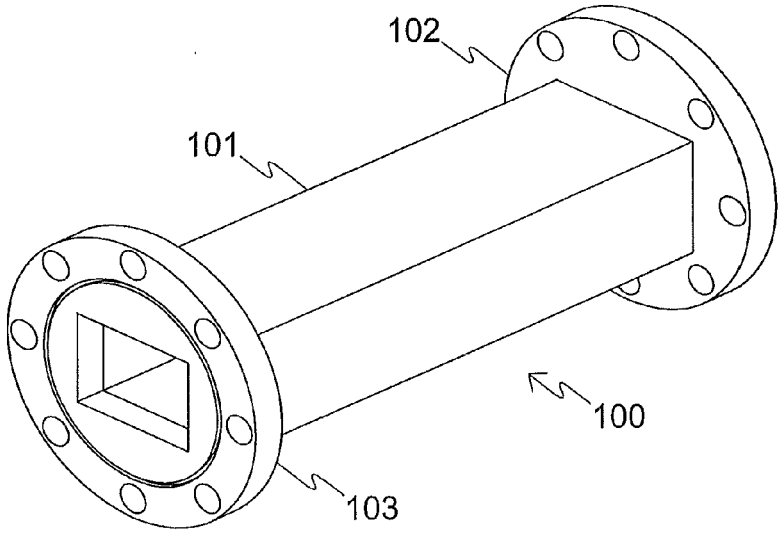
Fig. 1a (Prior art)
FIGS. 1*a* and 1*b* illustrate rectangular waveguides according to the prior art.
Figure 1B:
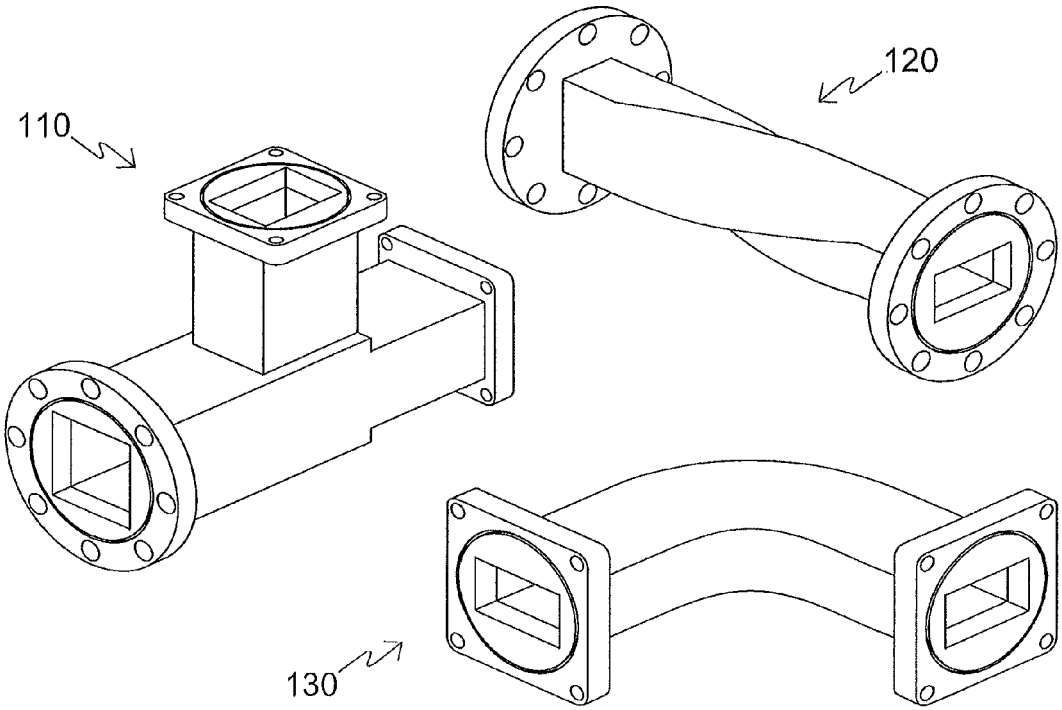
Fig. 1b (Prior art)
Figure 2A:
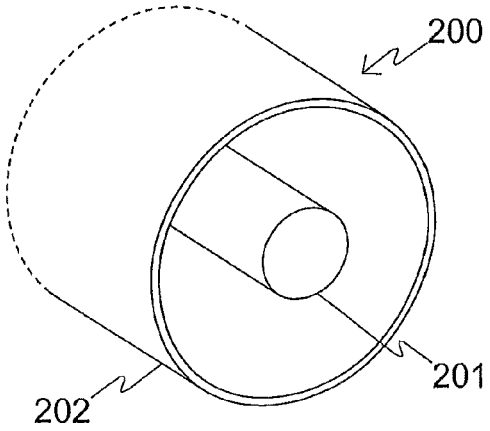
FIGS. 2*a* and 2*b* schematically illustrate a section of a waveguide according to an example of the present invention.
Figure 2B:
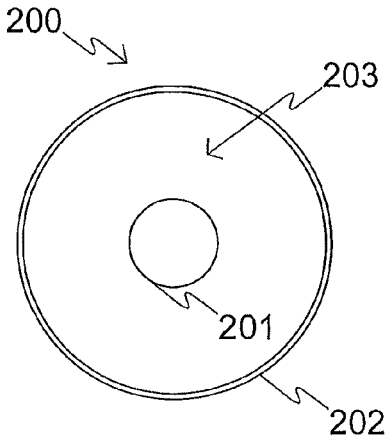

Referring now to FIGS. 2*a* and 2*b*, a section of a waveguide 200 is schematically illustrated according to an example of the present invention. The waveguide 200 is shown in perspective view in FIG. 2*a* and in cross-section in FIG. 2*b*. The waveguide 200 comprises a dielectric inner region 201 which is surrounded by an electrically conducting outer region 202. Both the inner region 201 and the outer region 202 are elongate along a long axis of the waveguide, and when viewed in cross-section perpendicular to this axis (e.g., FIG. 2*b*), the outer region 202 surrounds the inner region 201. As shown in FIG. 2*b*, the inner region 201 and the outer region 202 are separated from each other by an air gap 203. In the present example, the outer region 202 is formed as a thin-walled cylinder which surrounds the dielectric inner region 201.

In a conventional waveguide, energy losses are primarily due to current flowing in the surface of the metal waveguide pipe. In the present example, as the core has a relatively high dielectric constant and is surrounded by material having a relatively low dielectric constant, the fields are concentrated mainly in the dielectric core 201 and current flow in the outer region 202 is greatly reduced. Also in the present example, the dielectric core 201 is formed to be circular in cross-section in order to maintain the $TE_{01}$ transmission mode. The outer region 202 provides shielding, and ensures that field lines are confined within the dielectric core 201.

Preferably, to minimize losses, the core comprises a material with a high dielectric constant and low loss tangent, for example barium tetratitanate ($BaTi_4O_9$) or rutile ($TiO_2$). $BaTi_4O_9$ has a dielectric constant (also referred to as the relative static permittivity, $\in_r$) of 39, and rutile can have a dielectric constant as high as 200. The gap 203 between the dielectric core 201 and the outer region 202 is filled with a material, or materials, having a relatively low dielectric constant, such as air ($\in_r$~1.0) or PTFE ($\in_r$~2.1).

A comparison between losses in a waveguide such as the one shown in FIGS. 2*a* and 2*b*, and losses in a conventional waveguide, is made based on the Q factors of analogous half-wavelength resonators. For example, a half-wavelength resonator formed from a waveguide such as the one shown in FIGS. 2*a* and 2*b*, and having a dielectric core comprising $BaTi_4O_9$, may exhibit a Q factor of greater than 13,000 at Ku band. In comparison, a half-wavelength resonator formed from a conventional rectangular waveguide such as WR75 (for Ku band) typically has a Q factor of just 4,500. Therefore, losses in a waveguide such as that shown in FIGS. 2*a* and 2*b* may be approximately ⅓ that of a conventional waveguide. More generally, a reduction in losses may be achieved by using any dielectric material which offers a Q factor of greater than 4,500.

Additionally, a waveguide such as the one shown in FIGS. 2*a* and 2*b* may be smaller than a conventional rectangular waveguide, for any given frequency. For example, when the waveguide 200 of FIGS. 2*a* and 2*b* is arranged to carry microwave radiation at 12 GHz (i.e. Ku band), the dielectric core 201 may be formed to have a diameter of approximately 0.8 cm. In contrast, a conventional rectangular waveguide arranged to operate at 12 GHz has dimensions of approximately 2 cm×1 cm.

In one example of the present invention, the waveguide may be provided with SMA-type connectors at either end for providing matched connections to input or output ports. However, in other examples, alternative end connectors may be substituted depending on the particular type of connection provided on the input or output ports.

Figure 3:
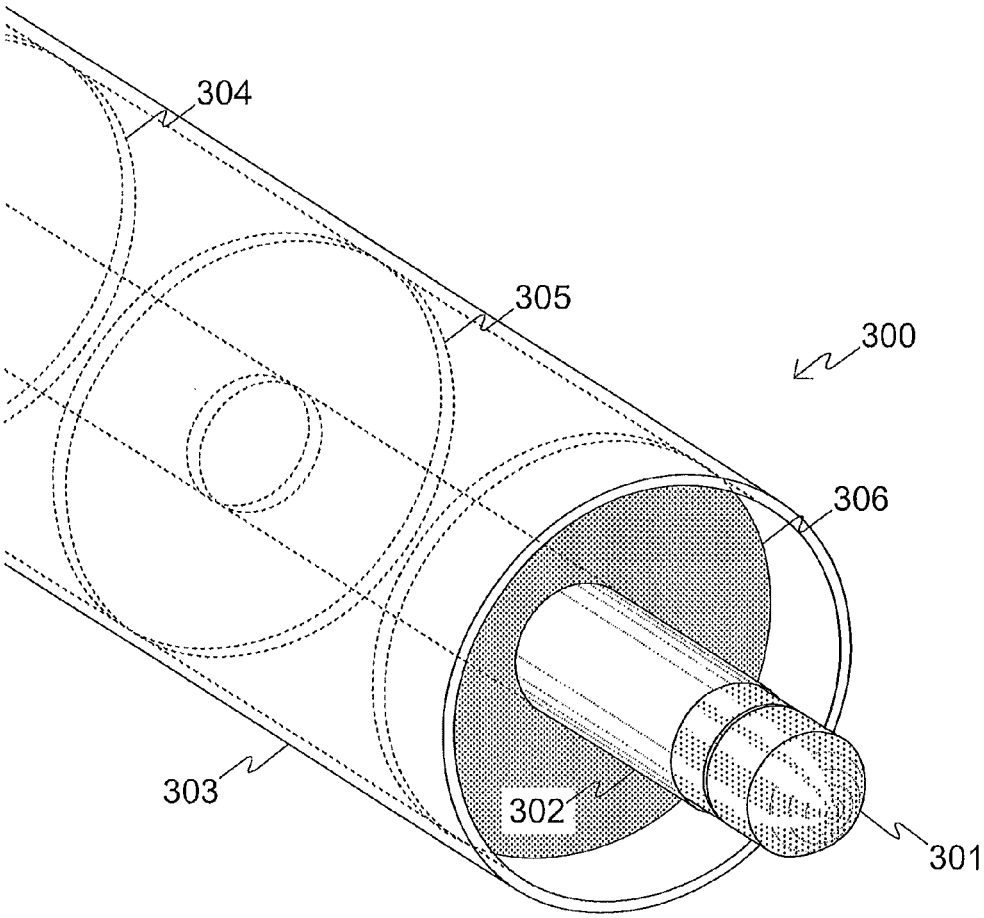
FIG. 3 illustrates the internal structure of a flexible waveguide cable, according to an example of the present invention.

FIG. 3 illustrates the internal structure of a section of flexible waveguide cable 300, according to an example of the present invention. In the present example, the dielectric inner region 301 comprises an assembly of ceramic discs contained within a flexible PTFE ('Teflon') tube 302, the discs being stacked end-to-end along a long axis of the cable 300. The discs are formed from sintered $BaTi_4O_9$ and have lenticular faces which allow the discs to rotate with respect to one another. This feature allows the cable 300 to be flexible and will be described in more detail later, with reference to FIGS. 4 to 6. Although in the present example the discs are formed from $BaTi_4O_9$, in other examples alternative dielectric materials may be used.

In order to maintain a separation between the dielectric inner region and the outer region 303, the waveguide cable 300 is provided with spacers 304, 305, 306. The spacers 304, 305, 306 comprise thin annular discs which fit around the dielectric core 301 of the cable 300, and are positioned at regular intervals along the cable 300. In the present example the spacers are formed from PTFE, but in other examples alternative materials may be used, for example Nylon. Preferably, the spacers are formed from an electrically insulating material having a low dielectric constant in order to ensure that the field lines are concentrated in the inner dielectric region 301. In some examples the spacers may be omitted altogether, for example in short, straight cable runs, or in rigid sections of waveguide.

Figure 4:
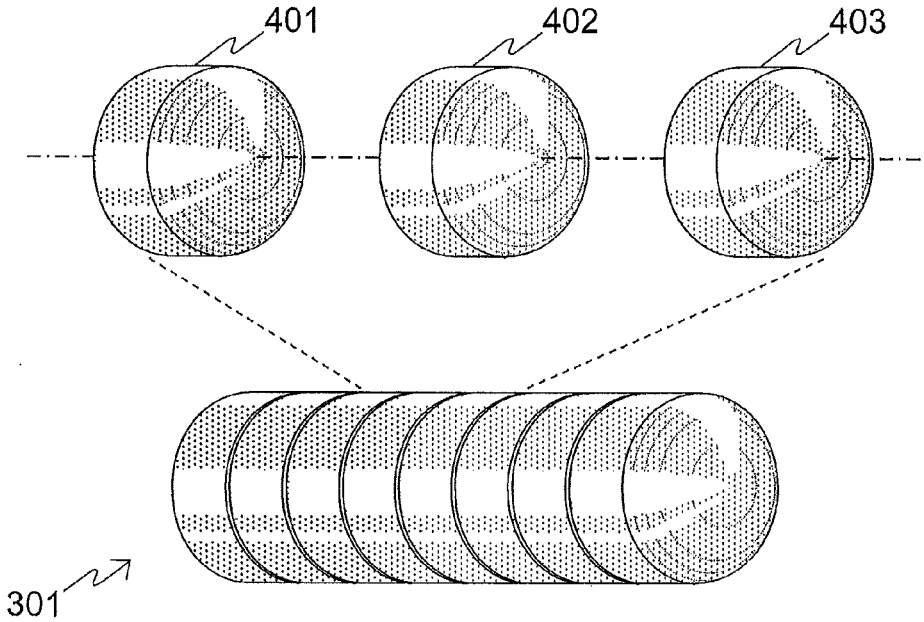
FIG. 4 illustrates the structure of the core of the cable shown in FIG. 3.

FIG. 4 illustrates the packing of discs 401, 402, 403 within the dielectric core 301 of the cable shown in FIG. 3. In the present example, the discs are all identical in form, having one convex face and one concave face (the concave face is hidden in FIG. 4). The convex and concave faces have similar curvatures, allowing the convex face of a disc 401 to fit into the concave face of an adjacent disc 402. However, it is not essential for all discs within the core to be identical. For instance, in other examples, two types of disc may be alternately stacked within the core 400, one type having two convex faces and the other type having two concave faces.

Figure 5:
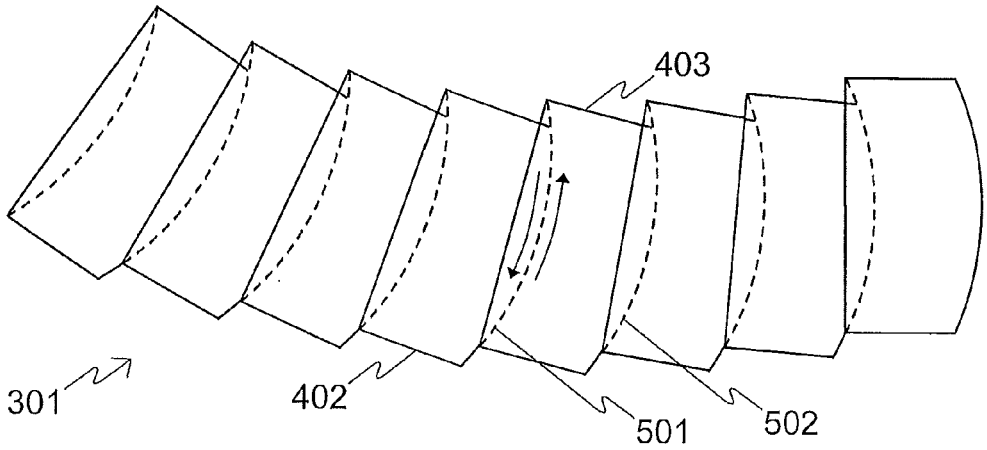
FIG. 5 illustrates how adjacent discs within the core shown in FIG. 3 are able to rotate with respect to one another.

The dielectric core 301 formed from stacked lenticular discs allows the cable to be flexible, as will now be described with reference to FIGS. 5 and 6. As shown in FIG. 5, in the present example each disc 403 within the dielectric core 301 has a concave face 501 and a convex face 502. When the cable is flexed, each disc 403 rotates with respect to an adjacent disc 402 due to the concave and convex faces of the two discs sliding across one another, as shown by the arrows in FIG. 5.

Figure 6:
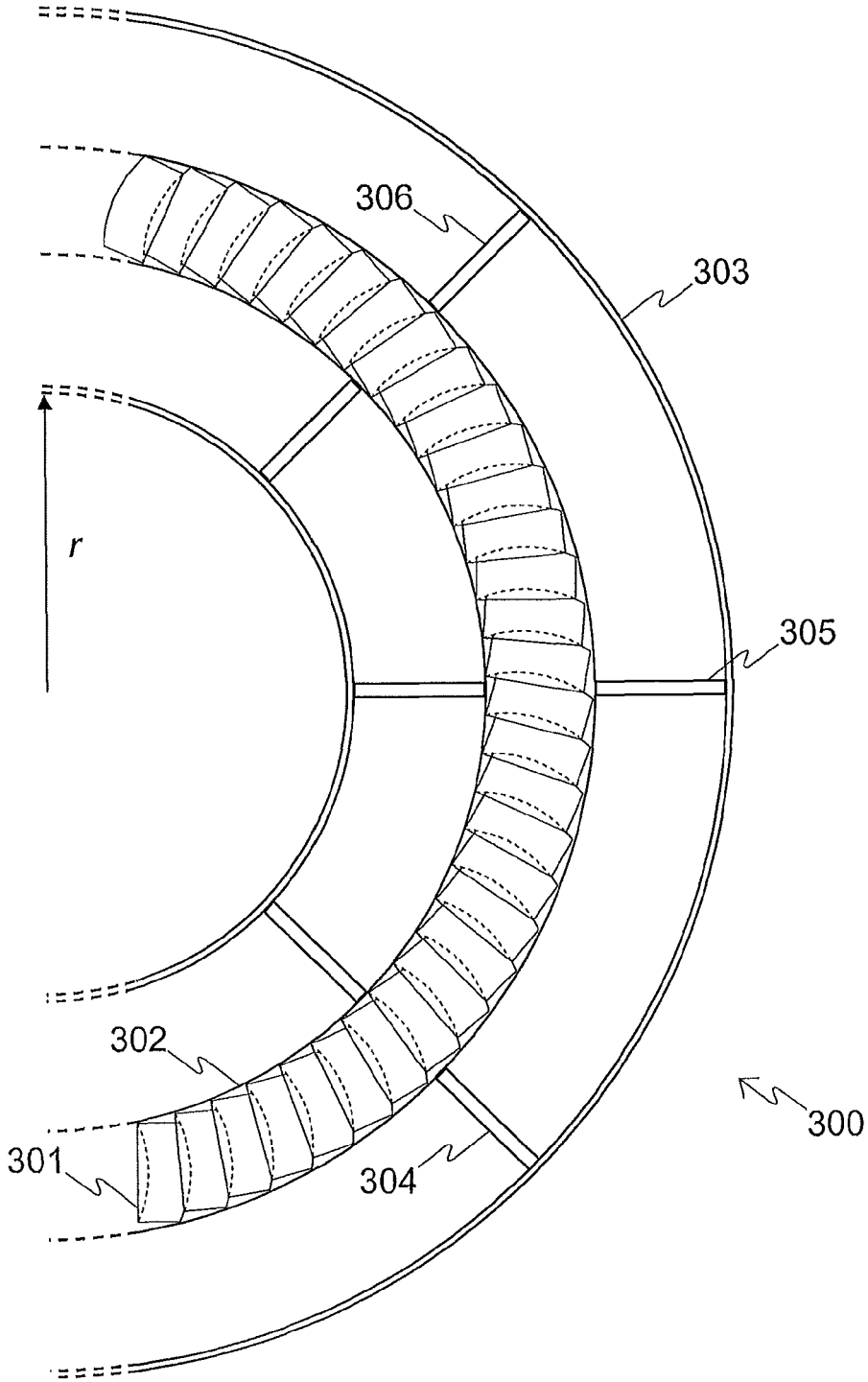
FIG. 6 illustrates a curved section of the flexible waveguide cable shown in FIG. 3.

FIG. 6 illustrates a cross-section of a curved section of the flexible waveguide cable 300 shown in FIG. 3. That is, FIG. 6 illustrates a section of the cable 300 which was initially straight, and has been bent to a particular radius of curvature r. In the present example, the electrically conducting outer region 303 comprises a thin-walled copper tube similar to that used in a conventional semi-rigid cables. As shown in FIG. 6, the PTFE spacers 304, 305, 306 maintain a separation between the dielectric core 301 and the electrically conducting outer region 303 even when the cable is bent. The spaces 304, 305, 306 comprise thin annular discs which fit around the dielectric core 301 of the cable 300. The dielectric core (e.g. inner region) 301 comprises an assembly of ceramic discs contained within the flexible PTFE tube 302.

Referring now to FIGS. 7*a* to 7*d*, alternative structures of the core of a flexible waveguide cable are illustrated, according to examples of the present invention. The various structures illustrated in FIGS. 7*a* to 7*d* are all substantially circular in cross-section, similar to the flexible waveguide cable shown in FIG. 3. The various structures of FIGS. 7*a* to 7*d* are designed to allow the dielectric core, and hence the cable itself, to be flexible. However, in cases where a flexible cable is not required, a dielectric core may simply be formed from a rigid ceramic rod.

Figure 7A:
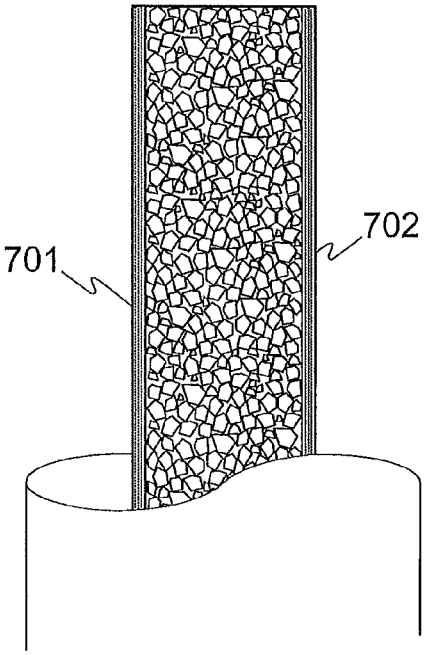
FIGS. 7*a* to 7*d* illustrate various alternative structures of the core of a flexible waveguide cable, according to examples of the present invention.

In FIG. 7*a*, the dielectric core comprises a thin-walled flexible polymer tube 701 filled with powdered dielectric 702. In the present example the polymer tube is formed from PTFE and the dielectric is $BaTi_4O_9$, but in other examples alternative materials may be substituted. Such a structure may be relatively simple and inexpensive to fabricate, and would be suitable for use in a flexible waveguide cable as the powder can move freely within the polymer tube, allowing the core to be bent and twisted as required.

Figure 7B:
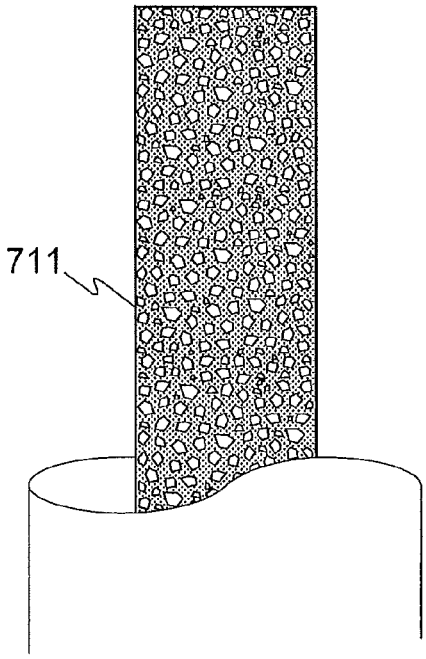

In FIG. 7*b*, the dielectric core 711 is formed from a flexible polymer-dielectric composite, which comprises particles of a dielectric material suspended in a polymer matrix. The dielectric particles give the composite a relatively high dielectric constant, which may be adjusted by controlling the volume fraction of particles. In the present example, the dielectric is $BaTi_4O_9$ and the polymer is PTFE, but in other examples alternative materials may be used. This arrangement may offer an advantage over the powder-filled tube of FIG. 7*a*, in which any tears developing in the tube (e.g. as a result of fatigue following repeated bending and straightening of the cable) may result in the powdered dielectric leaking out of the core. When a solid composite is used, as in FIG. 7*b*, the core 711 may be more resistant to this type of failure.

Figure 7C:
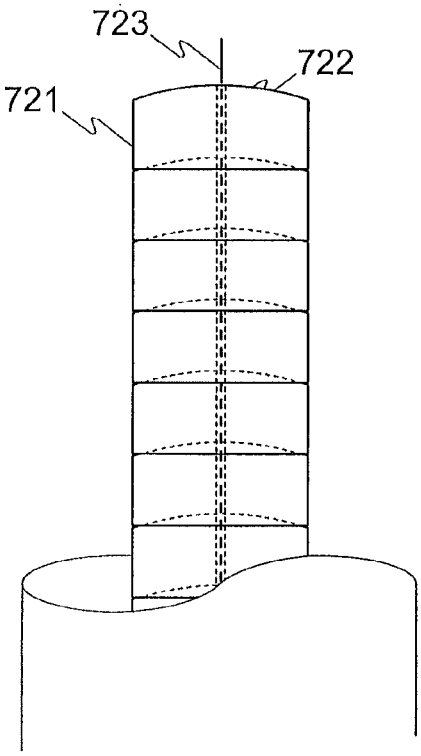

In FIG. 7*c*, the dielectric core comprises a plurality of stacked lenticular discs which are substantially similar to those shown in FIGS. 3 to 6, but differ in that each disc 721 has a central through-thickness hole 722. The discs are held together by a thread 723 which runs through the central hole of each disc. In the present example, it is not necessary to enclose the stacked discs in a flexible tube (e.g., FIG. 3) since the thread 723 already holds the discs in place.

Figure 7D:
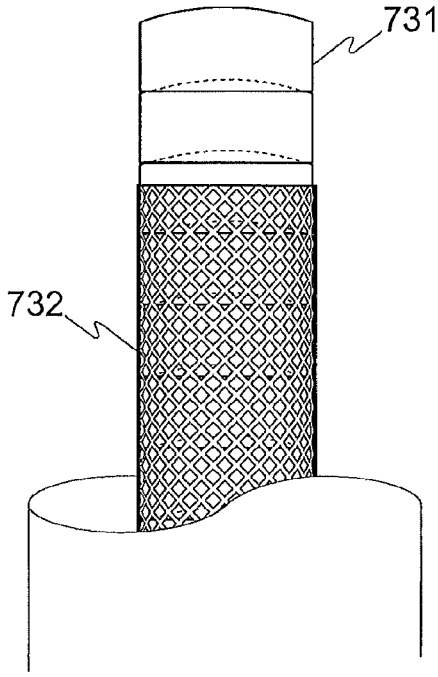

In FIG. 7*d*, the dielectric core again comprises a plurality of lenticular discs 731, and in this example the discs are held in place by a PTFE mesh tube 732. The mesh tube 731 may offer greater flexibility than a tube having a continuous wall (e.g., the PTFE tube 302 of FIG. 3), which may be more susceptible to kinking.

The use of a segmented ceramic core, such as in the examples above in which the dielectric core is formed from lenticular discs, may offer several advantages over a powdered or composite dielectric core (e.g., FIGS. 7*a* and 7*b*). Since each segment of the core (i.e. each lenticular disc) does not have to be flexible, the segments may be formed from solid ceramic. A dielectric core formed from a plurality of such segments may therefore have a higher dielectric constant than one formed from a dielectric powder or composite. Furthermore, the segmented dielectric core is not susceptible to kinking, and so can maintain a substantially constant cross-sectional area when the waveguide cable is bent.

Referring now to FIGS. 8*a* to 8*d*, various forms of spacers for use in a waveguide are illustrated according to examples of the present invention. The spacers provide a means for separating the dielectric inner region from the electrically conducting outer region. In FIGS. 8*a* to 8*d*, for clarity, structural details of the dielectric core have been omitted. The spacers shown in any of FIGS. 8*a* to 8*d* may be combined with various dielectric core structures, including (but not limited to) those illustrated in FIGS. 7*a* to 7*d*.

Figure 8A:
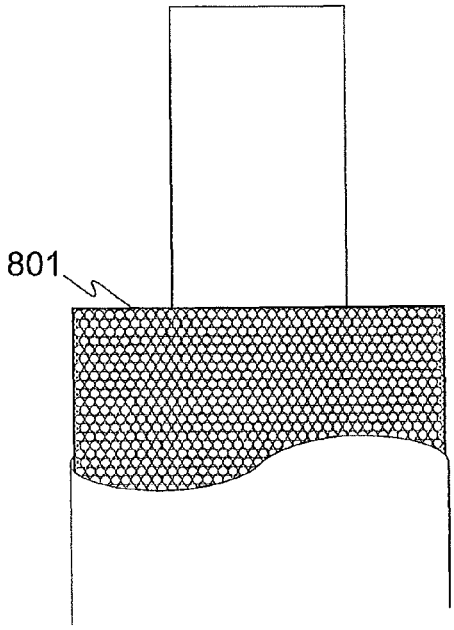
FIGS. 8*a* to 8*d* illustrate various forms of spacers for use in a waveguide according to examples of the present invention.
Figure 8B:
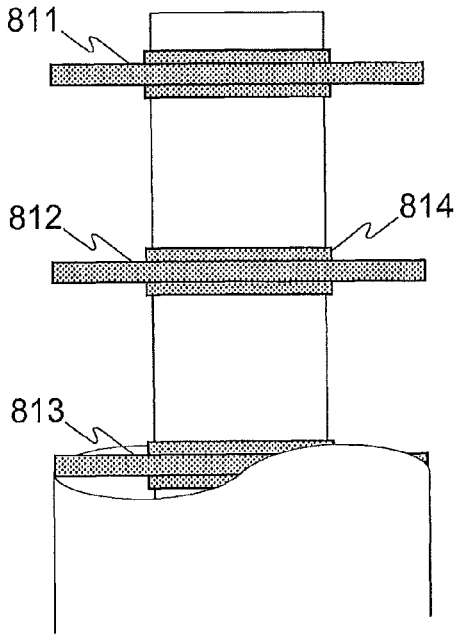
Figure 8C:
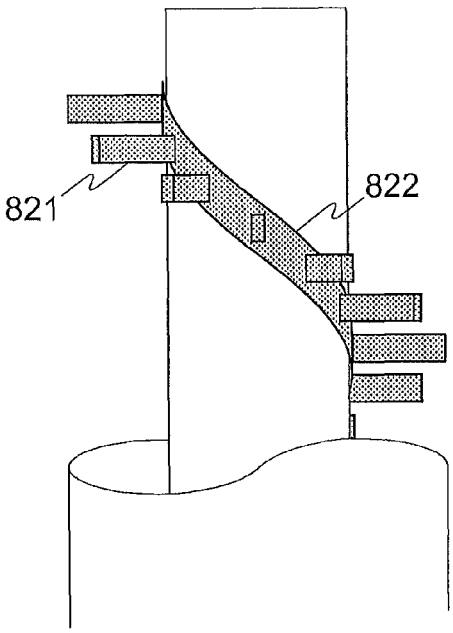
Figure 8D:
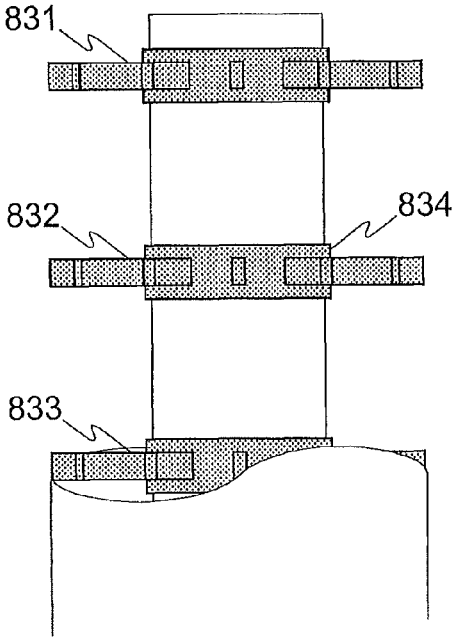

In FIG. 8*a*, a gap between the dielectric inner region and the electrically conducting outer region is filled with PTFE foam 801, which may protect the dielectric core from mechanical shock. In FIG. 8*b*, the spacers comprise annular discs 811, 812, 813 similar to those shown in the cable of FIG. 3. However, in the present example, each disc 812 is formed with a central collar 814 which is wider than a thickness of the disc. This may help to keep the spacer 812 substantially perpendicular to the dielectric core while the cable is bent. In FIG. 8*c*, a spacer comprises a plurality of arms 821 which are attached to a flexible ribbon 822. The ribbon 822 is wound around the dielectric core in a helical fashion, such that the arms 821 radiate out from the core and contact the outer wall of the cable. In FIG. 8*d*, spacers 831, 832, 833 are illustrated which each comprise a plurality of arms radiating out from a central collar 834. These may provide a reduction in the overall weight of the cable, in comparison to the solid spacers used in FIG. 8*b*.

Figure 9A:
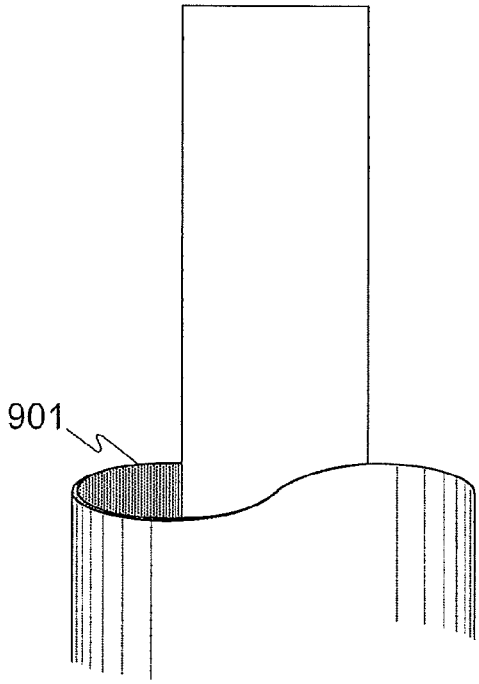
FIGS. 9*a* to 9*c* illustrate various forms of the electrically conducting outer region of a waveguide, according to examples of the present invention.
Figure 9B:
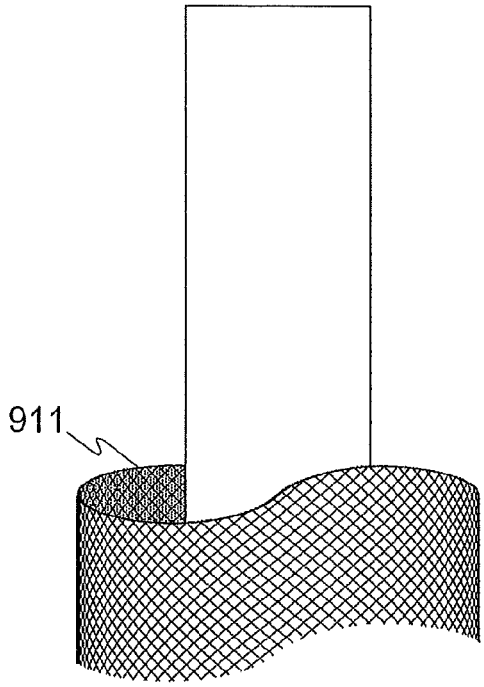
Figure 9C:
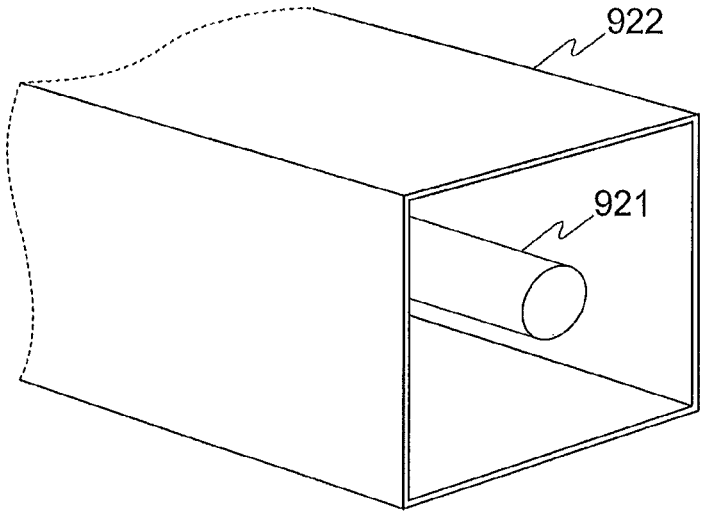

Referring now to FIGS. 9*a* to 9*c*, various forms of the electrically conducting outer region of a waveguide are illustrated according to examples of the present invention. In FIGS. 9*a* to 9*c*, for clarity, details of the dielectric core and any spacers have been omitted.

In FIG. 9*a*, a flexible cable is illustrated in which the electrically conducting outer region is formed from thin-walled tubular copper 901. The copper is ductile, allowing the cable to be bent as required. In FIG. 9*b*, a flexible cable is illustrated in which the electrically conducting outer region is formed from braided copper wire 911.

Although in the above-described examples, the electrically conducting outer region is illustrated as being circular in cross-section, and concentric with the inner dielectric region, this does not have to be the case. For example, as illustrated in FIG. 9*c*, the electrically conducting outer region 922 may have a different cross-section to the dielectric core 921.

While certain examples of the invention have been described above, it will be clear to the skilled person that many variations and modifications are possible while still falling within the scope of the invention as defined by the claims.

For instance, examples of the present invention have been described in which the dielectric core is formed from a plurality of ceramic discs with lenticular surfaces (e.g. FIGS. 7*c* and 7*d*). However, in other examples, the core may comprise elongate cylindrical segments with lenticular end faces. Such examples may be suitable when the waveguide cable does not need to be bent to a tight radius of curvature, since the number of individual parts within the core can be reduced, allowing fabrication of the cable to be simplified.

Additionally, although examples of the present invention have been disclosed in which the outer region comprises a metallic conductor, it is not essential that this be the outermost region of the cable. For instance, in some examples, the metallic outer region may itself be contained within a protective plastic or rubber sheath, to protect the cable from damage, or to provide thermal and electrical insulation from adjacent components.

The invention claimed is:

1. A waveguide comprising:

an elongate dielectric inner region comprising a flexible composite of dielectric particles in a polymer matrix; and an electrically conducting outer region spaced apart from the dielectric inner region.

2. The waveguide of claim 1, wherein the dielectric inner region comprises barium tetratitanate $BaTi_4O_9$.

3. The waveguide of claim 1, wherein the outer region comprises a thin-walled metal tube or a braided metal wire tube.

4. The waveguide of claim 1, wherein in a cross-section perpendicular to a long axis of the waveguide, the outer region is formed to have a substantially similar shape to the dielectric inner region, or is formed to have a different shape to the dielectric inner region.

5. The waveguide of claim 1, wherein the waveguide is arranged to guide electromagnetic radiation having a microwave wavelength.

6. The waveguide of claim 1, comprising:

separating means for maintaining a separation between the inner region and outer region, the separating means comprising an electrical insulator.

7. The waveguide of claim 6, wherein the separating means comprises:

foam arranged to surround the dielectric inner region; or a plurality of rigid annular discs, said discs being disposed at intervals along the length of the dielectric inner region; or a plurality of rigid radial arms attached to a flexible strip, said strip being wound around the dielectric inner region in a helical manner; or a plurality of spacers, each comprising a plurality of rigid radial arms attached to a central collar, said spacers being disposed at intervals along the length of the dielectric inner region.

8. A waveguide comprising:

an elongate dielectric inner region arranged to be flexible, the dielectric inner region comprising a plurality of segments each having lenticular end faces; and an electrically conducting outer region spaced apart from the dielectric inner region.

9. The waveguide of claim 8, wherein each one of the plurality of segments is formed to be substantially circular in a cross-section perpendicular to a long axis of the waveguide.

10. The waveguide of claim 9, wherein each one of the plurality of segments is formed from a sintered ceramic material.

11. The waveguide of claim 10, wherein the plurality of segments are contained within a flexible polymer tube.

12. The waveguide of claim 11, wherein each one of the plurality of segments is formed to have a central through hole, the waveguide further comprising a thread running through the central hole of each segment.

13. The waveguide of claim 12, comprising:

separating means for maintaining a separation between the flexible polymer tube and the outer region, the separating means comprising an electrical insulator.

14. The waveguide of claim 13, wherein the separating means comprises:

foam arranged to surround the flexible polymer tube; or a plurality of rigid annular discs, said discs being disposed at intervals along the length of the flexible polymer tube; or a plurality of rigid radial arms attached to a flexible strip, said strip being wound around the flexible polymer tube in a helical manner; or a plurality of spacers, each comprising a plurality of rigid radial arms attached to a central collar, said spacers being disposed at intervals along the length of the flexible polymer tube.

15. The waveguide of claim 11, wherein the plurality of segments are formed from barium tetratitanate $BaTi_4O_9$.

16. The waveguide of claim 8, wherein the waveguide is arranged to guide electromagnetic radiation having a microwave wavelength.

17. The waveguide of claim 8, wherein in a cross-section perpendicular to a long axis of the waveguide, the outer region is formed to have substantially a shape of the dielectric inner region, or is formed to have a different shape than the dielectric inner region.

18. The waveguide of claim 8, wherein the outer region comprises a thin-walled metal tube or a braided metal wire tube.

* * * * *